United States Patent [19]

Deissler

[11] 4,187,635

[45] Feb. 12, 1980

[54] METHOD AND APPARATUS FOR SOUND PRODUCTION

[76] Inventor: Robert J. Deissler, 4540 W. 213 St., Fairview Park, Ohio 44126

[21] Appl. No.: 892,822

[22] Filed: Apr. 3, 1978

[51] Int. Cl.[2] ..... A63H 5/00; G10D 13/08; G08B 1/00

[52] U.S. Cl. ..... 46/174; 46/182; 46/189; 84/409; 84/402; 116/168; 181/138

[58] Field of Search ..... 181/138, 175, 163, 157, 181/141; 46/1 C, 174, 189, 182, 188, 267, 52; 116/168, 137 R; 84/402, 409

[56] References Cited

U.S. PATENT DOCUMENTS

| | | | |
|---|---|---|---|
| 235,049 | 11/1880 | Walters et al. | 181/138 |
| 288,835 | 11/1883 | Miller | 181/138 |
| 351,704 | 10/1886 | Knudson | 181/138 |
| 352,577 | 11/1886 | Shaver | 181/138 |
| 382,713 | 5/1888 | Mason | 181/138 |
| 392,816 | 11/1888 | Mellett | 181/138 |
| 444,464 | 1/1891 | Shaver | 181/138 |
| 469,203 | 2/1892 | Eastman | 181/138 |
| 1,081,168 | 12/1913 | Sutlive | 46/189 |
| 1,199,196 | 9/1916 | McGonigle | 181/138 |
| 1,409,657 | 3/1922 | Boynton et al. | 84/173 |
| 1,731,570 | 10/1929 | Harrison | 181/175 |
| 2,059,603 | 11/1936 | Pflaum | 181/138 |
| 2,399,972 | 5/1946 | Zibelman | 181/138 |
| 2,853,145 | 9/1958 | Martin | 181/163 |
| 3,004,620 | 10/1961 | Baschet | 181/141 |
| 3,073,284 | 1/1963 | Roberts | 116/137 R |
| 3,082,838 | 3/1963 | Gajdosik | 181/138 |
| 3,176,788 | 4/1965 | Harris | 181/138 |
| 3,347,337 | 10/1967 | Mochida et al. | 181/157 |
| 3,424,850 | 1/1969 | Southard et al. | 181/157 |

FOREIGN PATENT DOCUMENTS

| | | | |
|---|---|---|---|
| 235596 | 6/1911 | Fed. Rep. of Germany | 181/138 |
| 1027110 | 2/1953 | France | 46/189 |
| 934632 | 8/1963 | United Kingdom | 181/175 |

*Primary Examiner*—Stephen J. Tomsky
*Attorney, Agent, or Firm*—Melvin F. Jager; Gary M. Ropski

[57] ABSTRACT

An apparatus and method for producing sound, particularly unusual sound effects, wherein the apparatus comprises at least one diaphragm and a spring attached to the diaphragm, having a lowest resonance frequency less than 18 hertz. The apparatus includes a resonator affixed to the diaphragm.

According to the method of the invention, sounds are produced on an instrument having a spring and a diaphragm connected to the spring by exciting an echophone frequency of the spring by either activating longitudinal motion of the spring, jerking at least one end of the spring in a longitudinal direction, longitudinally displacing and releasing a section of the spring, and moving at least one end of the spring longitudinally in a rhythmic motion to excite an echophone frequency.

16 Claims, 3 Drawing Figures

METHOD AND APPARATUS FOR SOUND PRODUCTION

BACKGROUND AND SUMMARY OF THE INVENTION

The present invention relates to devices and methods for amusement. In particular, the present invention is directed to an apparatus and method for producing sound and unusual sound effects.

In the prior art apparatus, the child's toy which consists of two cups or cans with a taut line between them is well-known. The physics of this prior art device is quite simple, consisting of the transmission of vibrations which impinge upon the diaphragm of a cup at one end through the string or other line to the diaphragm of the cup at the other end, where the second cup acts as a sound transmitter.

This device of the prior art is essentially used for the transmission of sound, and it is a goal in designing this device to accurately reproduce sound. In other words, the sound which enters one cup or can is reproduced substantially intact at the other cup or can; the only typical modification is the diminution in quality and volume of the sound.

Also known in the art are sophisticated electonic devices for producing sound effects. These devices may use electronic, mechanical, or a combination of electronic and mechanical devices to create, amplify, and reproduce sounds or sound effects which are typically used as background for films or music concerts. These devices are usually quite complicated and expensive, and do not lend themselves easily to amusement by children or other inexperienced operators.

The present invention is directed to a method and apparatus for producing sound and unusual sound effects which is much less expensive and much simpler in design than apparatus of the prior art. Unlike the prior art apparatus, the present invention is not designed to reproduce sound accurately. The apparatus of the present invention includes at least one diaphragm, and a spring attached to the diaphragm, having a lowest resonance frequency less than 18 hertz. A resonator is included and affixed to the diaphragm. A means for supporting each resonator is included, and such means provides support without substantially muffling the vibrations of each resonator. The ranges of particular dimensions of the apparatus, such as the spring constant, material construction of the diaphragm, diameter and thickness of the diaphragm, shape, volume, and depth of the resonator, and diameter of the spring are chosen within certain ranges according to the invention so as to maximize its utility and the efficiency of sound generation.

The invention therefore provides an inexpensive yet versatile sound-generating apparatus which is capable of producing a wide range of sounds of varying intensity, pitch, duration, amplitude, and rhythmic cycle. Modification of the sounds produced by the human voice box can also be accomplished. These objects are obtained also through utilization of the method of the invention, which involves the production of sound on an instrument having a spring and diaphragm connected to an end of the spring, a resonator affixed to the diaphragm, and at least one support member affixed to the resonator, wherein one or more of the following steps are taken so as to excite an echophone frequency of the spring: activating longitudinal motion of the spring, jerking at least one end of the spring in a longitudinal direction, longitudinally displacing and releasing a section of the spring, moving at least one end of the spring longitudinally in a rhythmic motion to excite an echophone frequency. The lowest echophone frequency is greater than both the lowest resonance frequency and the echo frequency of the apparatus.

According to the preferred embodiment of the method, the ends of the spring are positioned to stretch the spring so that no adjacent coils of the spring are in contact with each other. However, some steps of the method can be performed, although with less desirable results, when the ends of the spring are positioned so that at least two adjacent coils of the spring are in contact with each other.

The objects recited above and other objects, features, and advantages of the invention will become apparent upon reading the following detailed description of the invention in conjunction with the accompanying drawings.

DESCRIPTION OF THE PREFERRED EMBODIMENTS

Figure 1:
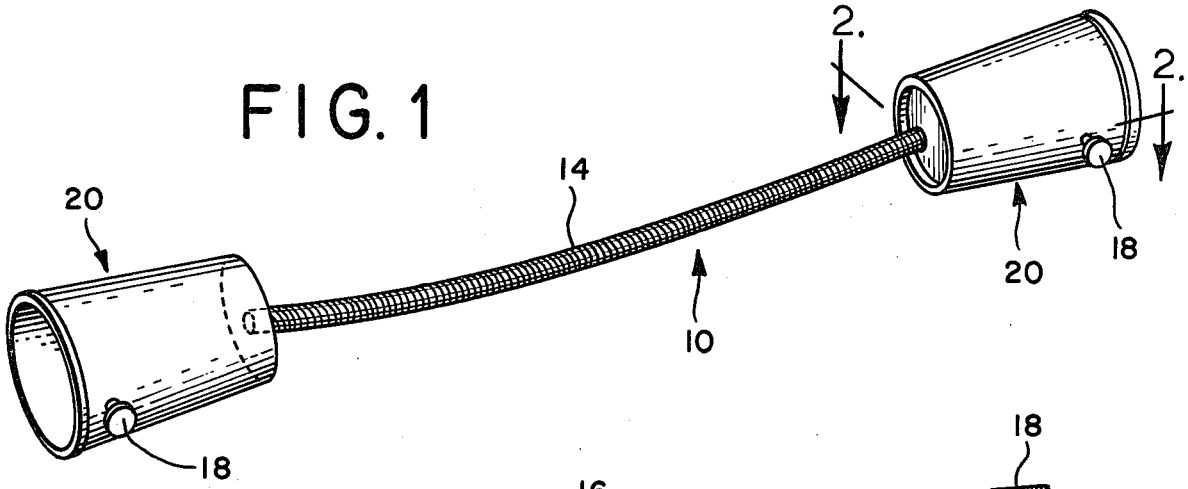
FIG. 1 is a side, perspective, view of an embodiment of the apparatus of the present invention.
Figure 2:
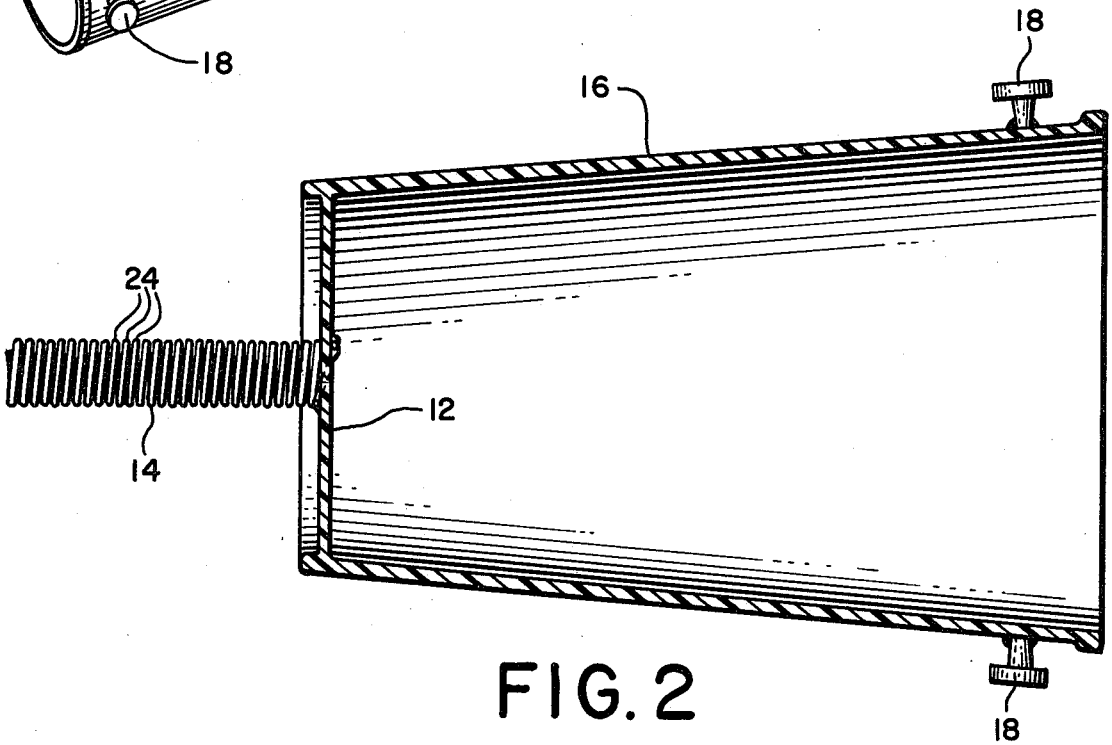
FIG. 2 is a cross-sectional view of one of the ends of the apparatus of the present invention, illustrating a cup and one end of a spring.

Referring now to the drawings, and more particularly to FIGS. 1 and 2, there is shown a sound-generating apparatus indicated generally by reference numeral 10. This apparatus includes a diaphragm 12, a spring 14, and a resonator 16. The spring 14 is securely attached to the diaphragm 12 by any suitable method, for instance, providing a hole in the diaphgram 12, inserting an end of the spring 14 through the hole in the diaphragm 12, and securing the end of the spring 14 to the diaphragm 12 by a glue or other adhesive. The means of securing the spring 14 to the diaphragm 12 should be such that vibrations at or near the audible sound range are efficiently transmitted with minimal distortion between the spring 14 and the diaphragm 12. According to another embodiment of the invention (not shown), the diaphragm 12 may be secured to the spring 14 at a position other than the end of the spring whereby the spring 14 is effectively divided into two springs positioned on either side of the diaphragm.

A number of unusual sound effects can be produced with an apparatus including only a diaphragm 12 and a spring 14 connected thereto. However, sounds and sound effects produced are louder and of higher quality when a resonator 16 is used in conjunction with the diaphragm 12 and the spring 14. According to the preferred embodiment of the invention, the resonator 16 and the diaphragm 12 are one integral unit, shown in FIGS. 1 and 2 as the cup 20. However, the resonator may be of a separate or different material from the diaphragm 12, and secured to the diaphragm 12 by adhesive, glue, or other means which will not substantially muffle sound vibration transmission between the diaphragm 12 and the resonator 16.

As illustrated in FIG. 1, two cups 20 are provided, including two diaphragms 12 and two resonators 16. The cups 20 are connected to the spring 14, one at each end of the spring 14, so as to increase the possible range of sound and sound effects which may be generated and transmitted with the apparatus of the invention. Other embodiments (not shown) include setting the apparatus in a frame to maintain desired tension on the spring 14, surrounding the spring 14 and diaphragm 12 of the apparatus with a hollow tube or a plurality of telescoping tubes, and multiple or interconnected arrangements of diaphragms, resonators and springs.

According to the preferred embodiment of the invention, several parameters of the spring 14, diaphragm 12, and resonator 16 have been chosen. The spring constant is chosen to provide a spring which can easily be extended, usually under hand tension, so that adjacent coils 24 have spaces between them. For a helical spring made from the circular wire, the spring constant is written in terms of other parameters of the spring as follows:

$$K = \frac{Gd^4}{8D^3 i}$$

where G is the torsion modulus of the material used in the spring, d is the diameter of the wire of the spring, D is the diameter of a coil of the spring, and i is the number of coils in the spring. In the preferred embodiment, the spring constant ranges from 0.02 to 25.0 newtons per meter.

The spring parameters are chosen to provide a lowest echophone frequency less than about 20 hertz, so that the frequency will produce the effect of a series of pulses or tones to the human ear, and not a single tone. The echophone frequencies are defined as those frequencies at which an end of the spring is moved longitudinally in a rhythmic motion to produce relative maximums in the acoustical output for a given mechanical input, with adjacent coils of the spring remaining separated during their oscillations. Sound is emitted in pulses at the echophone frequency. The frequencies at which an end of the spring is moved so that sound is produced (without adjacent spring coil hitting) are sharply peaked around the echophone frequencies.

The echophone frequencies differ from the resonance frequencies of the spring. The resonance frequencies are those frequencies at which an end of the spring is moved longitudinally in a rhythmic motion to cause relative maximums in the longitudinal displacement of the coils for a given mechanical input. The echophone frequencies are greater (approximately 13 percent in the example below) than the resonance frequencies. Also, there may be an echophone frequency associated with each resonance frequency, the higher resonance and echophone frequencies being approximately integral multiples of the lowest resonance and echophone frequencies, respectively. The lowest echophone frequency is also greater (approximately 13 percent in the example below) than the echo frequency, which is defined as the frequency at which a sound pulse echos back and forth between the ends of a spring.

The lowest resonance frequency can be defined as follows:

$$f \cong \tfrac{1}{2}\sqrt{\frac{K}{m}}$$

where m is the mass of the spring and K is the spring constant. Because $$m = \frac{i}{4}\pi^2 \rho D d^2$$

where $\rho$ is the density of the wire used in the spring, and using the formula for the spring constant, K, the lowest resonance frequency for a helical spring made from circular wire can be defined in terms of other variables as follows:

$$f \cong \frac{1}{2\pi}\sqrt{\frac{G}{2\rho}}\ \frac{d}{iD^2}$$

Since the lowest resonance frequency is approximately equal to the echo frequency, is slightly less than the lowest echophone frequency, and can be simply defined in terms of other parameters of the spring, the lowest resonance frequency is an important parameter. The lower the value of the lowest resonance frequency of the spring, the longer the echo time of the apparatus. In the preferred embodiment, the lowest resonance frequency ranges from 0.06 to 18 hertz.

The apparatus of the preferred embodiment is provided with a spring 14 having an unextended length of from 0.05 meters to 10 meters, average wire diameter, d, from 0.1 millimeters to 3 millimeters, and average coil diameter, D, from 0.2 centimeters to 10 centimeters. In terms of the wire diameter, d, and the number of coils, i, the unextended length of the spring for an extension spring is equal to i×d. The composition of the wire comprising the spring 14 may be any suitable wire, typically metal, which provides sufficient flexibility and compactness of size so that it may be easily extended and operated in the apparatus.

According to the preferred embodiment, the diaphragm 12 produces the loudest and highest quality, best fidelity sound when it is made from styrofoam or another semi-rigid closed-cell, polymer foam. Cardboard, wood, metals, other semi-rigid plastics, and tightly stretched plastic sheets (such as drum heads) all work to varying degrees of success. The thickness of the diaphragm depends on the material selected and the diameter of the diaphragm. For styrofoam, preferred dimensions have been found to be 1 to 30 centimeters for the diameter of the diaphragm, with a corresponding thickness from 0.2 to 20 millimeters.

Suitable material which forms the resonator 16 may be chosen by one skilled in the art. Rather, the shape and dimensions of the resonator 16 mainly determine the effectiveness of the resonator 16 particularly in directing aerial vibrations against the diaphragm. These aerial vibrations are directed against the diaphragm 12 by being reflected from the walls of the resonator 16 onto the diaphragm 12. According to the embodiment depicted in FIG. 1, as discussed briefly above, the resonator 16 is integrally related with the diaphragm 12. As shown in the embodiment of FIGS. 1 and 2, the cup 20, which includes the resonator 16 and the diaphragm 12, is a styrofoam cup such as those typically used for containing hot or cold liquids. The resonator 16 is preferably frusto-conical in shape so that the walls of the cavity flare away from the diaphragm 12. The preferred volume of the resonator 16 is from 0.06 to 2 liters. The depth of the resonator 16 has preferably been found to be from 3 centimeters to 30 centimeters. The sides of the resonator 16 are flared outward so that optimum impedence matching with the ambient air is provided in the cavity of the resonator 16.

In order to isolate vibrations of the resonator 16 from dampening or muffling effects when the cavity is supported either on a frame (not shown) or held in the hand, support members in the form of pins 18 may be provided. These pins have minimal area while still being large enough to be grasped, and are attached to each resonator 16, preferably in a symmetrical position about the circumference of the resonator walls. The pins 18 may be of any suitable material such as plastic, or rubber, which does not transmit sound vibrations readily.

Figure 3:
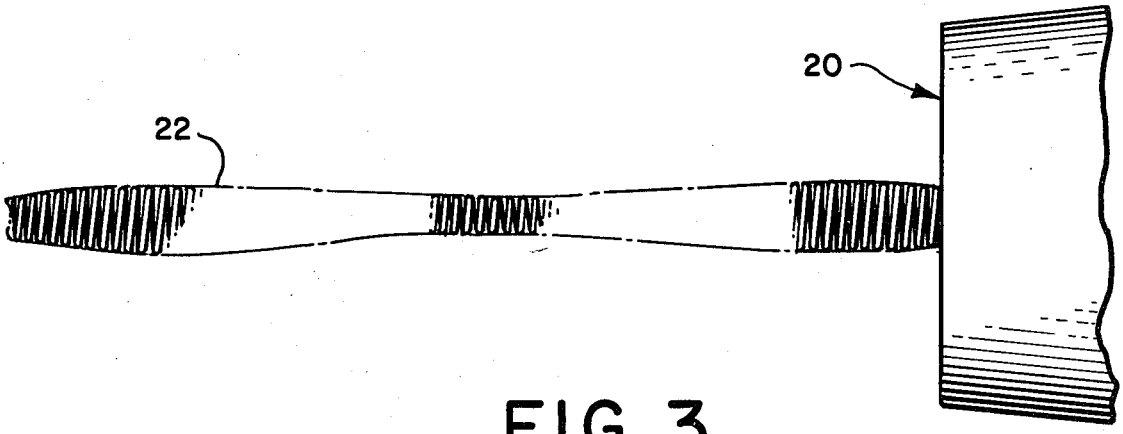
FIG. 3 is a side view of a portion of a cup and a spring with varying diameter used in a further embodiment of the present invention.

According to a further embodiment of the apparatus, as partially illustrated in FIG. 3, a spring 22 is provided, having a diameter whch varies gradually along the length of the spring 22. The fluctuation of the diameter of the spring 22 is preferably gradual, and the number of fluctuations from a given diameter to a smaller diameter and back to a given diameter, or from a given diameter to a larger diameter and back to the given diameter, depend upon the quality or unusual nature of the sound which is desired to be produced by the apparatus 10. Additionally, the cross-section of the spring 14 or the spring 22 need not be circular, but could be elliptical as well. The wire which comprises the spring 14 or 22 need not be circular, but can also be square, elliptical, or other like shapes, and can vary in diameter. Furthermore, the diaphragm 12 could also be square, oval, circular, or any other configuration which readily accepts and transmits wavelengths in the audible sound range.

The apparatus of the present invention and its various embodiments produces a quality of sound which is unexpected from the simple nature of the device and has been typically produced prior to the invention with sophisticated electronic or electro-mechanical apparatus. The sounds take the form of bursts, waves of sound which build and then die off, rasping sounds, pulses, and other types of sounds which are considered unusual by the typical listener. According to the method of the present invention, these sounds are produced by a pluralty of steps. When an instrument of apparatus is used having a spring 14 or 22 and a diaphragm 12 connected to an end of the spring 14 or 22, the initial steps of the method may include positioning the diaphragm 12 and an end of the spring 14 or 22 opposite the diaphragm 12 to stretch the spring 14 or 22 so that no two adjacent coils 24 of the spring are in contact with each other. This permits the sound transmission to occur only through the material of the spring 14 or 22 itself, not by collisions of adjacent coils 24 of the spring 14 or 22 against one another.

The second step of the method may be used without the first step, and differs depending on the type or quality of the sound or sound effects desired to be produced. That second step can comprise: (1) striking or tapping the spring 14 or 22 with fingers or other objects; (2) activating longitudinal motion of the spring 14 or 22, such as by sliding fingers or other objects along the spring coils; (3) activating a longitudinal motion of the spring 14 or 22 by plucking at least one coil of the spring 14 or 22; (4) activating longitudinal motion of the spring 14 or 22 by rubbing the spring 14 or 22; (5) striking a diaphragm 12; (6) jerking at least one end of the spring 14 or 22 in a longitudinal direction; (7) moving at least one end of the spring 14 or 22 longitudinally in a rhythmic motion to excite an echophone frequency; (8) longitudinally displacing a section of the spring 14 or 22 from a rest position and allowing the longitudinally displaced section to return to and beyond the rest position; (9) moving at least one end of the spring 14 or 22 longitudinally in a rhythmic motion to cause adjacent coils 24 to hit one another; and (10) directing aerial vibrations against the diaphragm 12.

When a person speaks into a resonator 16, the person can hear echos in the resonator 16 for as long as ten or more seconds after speaking. The period of time between echos depends on the lowest resonance frequency and the decay time depends upon the lowest resonance frequency and other parameters. Also, the frequency of the sound waves emerging depends upon the frequency of the sound waves directed against the diaphragm 12. In order to hear echos the lowest resonance frequency must be low enough, preferably less than ten hertz when the human voice is used to vibrate the diaphragm 12.

Although the method of the present invention has included a step of positioning the diaphragm 12 and an end of the spring 14 or 22 opposite the diaphragm 12 so that no adjacent coils 24 of the spring 14 or 22 are in contact with each other, the method of the present invention, with the exception of exciting an echophone frequency, could also be practiced, although with less desirable results, when one or more of the adjacent coils 24 of the spring 14 and 22 are in contact. The quality and loudness of the sound produced will be markedly different from the situation in which the spring 14 or 22 is fully extended and no adjacent coils 24 are touching.

As a general rule it as been found that with longer springs an impulsive rhythmic motion of a spring end with a peaked curve of displacement with respect to time is more effective in exciting an echophone frequency than a smooth rhythmic motion. The impulsive rhythmic motion should produce displacement of the spring to a less extended length in a period of time which is shorter than that during which the spring is driven to its original length. The curve of such displacement with respect to time would therefore approach a sawtooth form. A further consideration is that as sound wave echos back and forth between a system involving more than one diaphragm 12, the time delay between pulses of the sound waves will be greater in longer springs than shorter springs if the other parameters (coil and wire diameters) are held constant.

The following example is intended to set forth one of the ways in which the invention has been practiced, and is not intended to limit the scope of the invention. Several advantages of the invention will become apparent through this example, along with a fuller understanding of the phrase "echophone frequency."

Example

The lowest echophone frequency of a particular embodiment of the apparatus of the present invention and its relationship to the echo and lowest resonance frequencies were determined as follows. An apparatus comprising a spring and two styrofoam cups including a resonator and diaphragm was utilized. The spring had an unextended length of 66.8 centimeters, with an outside coil diameter of 0.95 centimeters or of $\frac{3}{8}$ inches and a wire diameter of 0.051 centimeters, or 0.02 inches. The styrofoam cup was 16 ounces or 0.47 liters in volume. The diaphragm was 3 millimeters thick and 6.2 centimeters in diameter. The depth of the resonator (cup) was 13 centimeters, and was conical with a top diameter of 9 centimeters. The spring had a spring constant of about 0.67 newtons/meter. The spring was stretched to a length of about 2 meters, so that no adjacent coils of the spring were touching one another.

When the cup was moved in an oscillatory motion the emplitude of the motion was about 25 centimeters by hand motion. To determine the echo frequency, a coil was plucked and sound waves were measured with a metronome as traveling from one cup to another cup and back to the original cup at a range of 106±2 cycles per minute, thereby setting the echo frequency at approximately 106 cycles per minute. All the frequencies obtained in this example were measured with a metronome, producing an error of ±2 cycles per minute. When a coil was plucked, the bottom of the cup was tapped, or a sharp sound was directed into the cup, each of the resulting sounds echoed at 106±2 cycles per minute and took approximately ten seconds to decay to an imperceptible level.

When one of the cups was moved in a smooth oscillatory fashion toward and away from another of the cups starting from a position in which none of the adjacent coils of the spring were touching one another, the coils of the spring bumped into one another and sent waves of sound in the mechanical fashion along the length of the spring. The lowest oscillation frequency at which this effect was observed defined the mechanical resonance frequency, also approximately 106 cycles per minute.

However, when one of the cups was moved in a smooth oscillatory fashion towards and away from the other cup at 120±2 cycles per minute, the sound was emitted in pulses at a frequency of about 120 pulses per minute, after an approximately eight second delay before sound was emitted. Even when the motion of the cup was stopped, the pulses continued to be emitted from one of the cups at approximately 120 pulses per minute, until they reached an imperceptible level. The period of time from stopping the excitation of the spring until the sound died down to a barely perceptible level was approximately 40 seconds for sound waves generated when the system was excited to an echophone frequency. This period of decay is much longer than the typical period for an echo frequency of about 10 seconds. Even when one of the cups was given a single sharp jerk, or a few sharp jerks at the lowest echophone frequency, and the cup was then held still, sound built up from an imperceptible level to a perceptible level after about 4 seconds, and was emitted at the lowest echophone frequency.

It will be obvious to those skilled in the art that the various portions of the apparatus shown and described here could be not only modified as previously described but also multiplied for further interesting and unusual sound effects. Thus, two springs of either the same or differing tensions could be attached between the same two diaphragms, with multiple effects produced therefrom. Additionally, two or more springs could be affixed in a manner to produce three or more free ends, and as many diaphragms attached as there are free ends.

Though the embodiments here and before described are preferred, many modifications and refinements which do not depart from the true spirit and scope of the invention may be conceived from those skilled in the art. It is intended that all such modifications and refinements be covered by the following claims.

I claim:

1. An apparatus for producing sound effects comprising:

two diaphragms;

a resonator affixed to each diaphragm;

a helically-coiled spring positioned between and attached to the diaphragms whereby said diaphragms can be moved with respect to each other to induce spring, diaphragm, and resonator vibrations, said spring having a lowest resonance frequency less than 18 hertz; and at least one support member affixed to each resonator whereby each resonator can be supported vibrations without substantially muffling the vibrations of each resonator.

2. The apparatus of claim 1 wherein the support members comprise pins.

3. The apparatus of claim 1 wherein the spring has a spring constant between 0.02 and 25.0 newtons per meter.

4. The apparatus of claim 1 wherein at least one diaphragm is a semi-rigid, closed-cell polymer foam.

5. The apparatus of claim 4 wherein the diameter of the diaphragm is between 1 and 30 centimeters, and the thickness of the diaphragm is between 0.02 and 2 centimeters.

6. The apparatus of claim 1 wherein at least one resonator is a semi-rigid, closed-cell polymer foam.

7. The apparatus of claim 1 wherein each resonator is frusto-conical in shape so that the walls of each resonator flare away from the diaphragm.

8. The apparatus of claim 1 wherein the resonator has a volume of between 60 milliliters and 2 liters and a depth of between 3 and 30 centimeters.

9. The apparatus of claim 1 wherein the diameter of the spring varies gradually along the length of the spring.

10. An apparatus for producing sound effects, comprising:

at least one diaphragm;

a resonator affixed to the diaphragm;

a spring attached to the diaphragm, said spring having a lowest resonance frequency less than 18 hertz; and at least one support member affixed to the resonator whereby the resonator can be supported without substantially muffling the vibrations of the resonator.

11. The apparatus of claim 10 wherein the support members comprise pins.

12. A method for producing sounds on an instrument including at least one diaphragm, a resonator affixed to the diaphragm, a spring attached to the diaphragm so that said diaphragm and said spring can be moved with respect to each other to induce spring and diaphragm vibrations, said spring having a lowest resonance frequency less than 18 hertz, and at least one support member affixed to the resonator, whereby the resonator can be supported without substantially muffling the vibrations of the resonator, comprising:

exciting an echophone frequency of the spring by the activating longitudinal motion of the spring.

13. A method for producing sounds on an instrument including at least one diaphragm, a resonator affixed to the diaphragm, a spring attached to the diaphragm so that said diaphragm and said spring can be moved with respect to each other to induce spring and diaphragm vibrations, said spring having a lowest resonance frequency less than 18 hertz, and at least one support member affixed to to the resonator, whereby the resonator can be supported without substantially muffling the vibrations of the resonator, comprising:

exciting an echophone frequency of the spring by jerking at least one end of the spring in a longitudinal direction.

14. A method for producing sounds on an instrument including at least one diaphragm, a resonator affixed to the diaphragm, a spring attached to the diaphragm so that said diaphragm and said spring can be moved with respect to each other to induce spring and diaphragm vibrations, said spring having a lowest resonance frequency less than 18 hertz, and at least one support member affixed to the resonator, whereby the resonator can be supported without substantially muffling the vibrations of the resonator, comprising:

exciting an echophone frequency of the spring by longitudinally displacing a section of the spring from a rest position, and allowing the longitudinally displaced section to return to and beyond the rest position.

15. The method of claims 12, 13 or 14, wherein a first step prior to the exciting step comprises positioning the diaphragm to stretch the spring so that no two adjacent coils of the spring are in contact with each other.

16. A method for producing sounds on an instrument including a spring having a lowest resonance frequency less than 18 hertz and a diaphragm connected to the spring, a resonator affixed to the diaphragm, and at least one support member affixed to the resonator, comprising:

positioning the diaphragm to stretch the spring so that no two adjacent coils of the spring are in contact with each other; and moving at least one end of the spring longitudinally to excite an echophone frequency.

* * * * *

UNITED STATES PATENT AND TRADEMARK OFFICE

CERTIFICATE OF CORRECTION

PATENT NO. : 4,187,635

DATED : February 12, 1980

INVENTOR(S) : Robert J. Deissler

It is certified that error appears in the above-identified patent and that said Letters Patent are hereby corrected as shown below:

In Column 1, line 49, after "material" insert --,--.

In Column 2, line 3, after "spring," insert --and--.

In Column 3, line 20, after "from" delete "the".

In Column 3, line 47, after "spring" delete "coil" and insert --coils-- therefor.

In Column 6, line 33, after "14" delete "and" and insert --or-- therefor.

In Claim 1 at Column 8, lines 16 and 17, after "supported" delete "vibrations".

In Claim 12 at Column 8, line 64, after "by" delete "the".

Signed and Sealed this

*Twenty-sixth* Day of *August 1980*

[SEAL]

*Attest:*

SIDNEY A. DIAMOND

*Attesting Officer*

*Commissioner of Patents and Trademarks*